US007281568B2

(12) United States Patent
Mergen et al.

(10) Patent No.: US 7,281,568 B2
(45) Date of Patent: Oct. 16, 2007

(54) METHOD FOR PRODUCING A STRATIFIED COMPOSITE MATERIAL

(75) Inventors: Robert Mergen, Altmünster (AT); Günther Kutzik, Gmunden (AT)

(73) Assignee: Miba Gleitlager GmbH, Laakirchen (AT)

( * ) Notice: Subject to any disclaimer, the term of this patent is extended or adjusted under 35 U.S.C. 154(b) by 20 days.

(21) Appl. No.: 11/142,144

(22) Filed: Jun. 1, 2005

(65) Prior Publication Data

US 2005/0269056 A1 Dec. 8, 2005

(30) Foreign Application Priority Data

Jun. 2, 2004 (AT) ..... A 947/2004

(51) Int. Cl.
*B22D 11/00* (2006.01)
*B22D 19/00* (2006.01)
*B22D 19/02* (2006.01)

(52) U.S. Cl. ..... 164/461; 164/419; 164/103

(58) Field of Classification Search ..... 164/461, 164/419, 103
See application file for complete search history.

(56) References Cited

U.S. PATENT DOCUMENTS 5,226,953 A * 7/1993 Hodes et al. ..... 75/693
5,305,816 A * 4/1994 Ikawa ..... 164/46
2003/0006021 A1* 1/2003 Periera ..... 164/451

FOREIGN PATENT DOCUMENTS

| | | | |
|---|---|---|---|
| DE | 10246887 | | 4/2004 |
| EP | 0709491 | | 5/1996 |
| GB | 544903 | | 5/1942 |
| GB | 2383051 | | 6/2003 |
| JP | 55076068 | | 6/1980 |
| JP | 61-49749 | * | 3/1986 |
| JP | 61-49750 | * | 3/1986 |
| JP | 2003183707 | | 7/2003 |
| WO | WO9936210 | | 7/1999 |

* cited by examiner

*Primary Examiner*—Kuang Y. Lin
(74) *Attorney, Agent, or Firm*—Collard & Roe, P.C.

(57) ABSTRACT

A method is described for producing a stratified composite material, with a melt of a layer material being cast progressively in a forward feed direction onto a strip-like metal carrier which is heated to a treatment temperature required for the bonding with the layer material and is cooled below the melting temperature after the casting via the metal carrier. In order to provide advantageous casting conditions it is proposed that the metal carrier is heated continuously with a temperature profile prior to the casting of the melt of the layer material in the forward feed direction, which temperature profile decreases towards lower temperatures from a maximum temperature below the treatment temperature in the region of a surface layer receiving the melt towards a core layer of the metal carrier, and that the metal carrier is heated in a surface layer by the melt to the treatment temperature upon casting of the melt which is overheated for this purpose.

3 Claims, 1 Drawing Sheet

METHOD FOR PRODUCING A STRATIFIED COMPOSITE MATERIAL

FIELD OF THE INVENTION

The invention relates to a method for producing a stratified composite material, wherein a melt of a layer material is cast progressively in a forward feed direction onto a strip-like metal carrier which is heated to a treatment temperature required for the bonding with the layer material and is cooled after the casting by the metal carrier below the melting temperature.

DESCRIPTION OF THE PRIOR ACT

One possibility for producing a stratified composite material from a strip-like metal carrier and a metallic layer material is heating at first the metal carrier to a treatment temperature which is required for a later bonding with the layer material and lies above the melting temperature of the layer material and thereafter casting the melt of the layer material onto the heated metal carrier. After the casting it is necessary to rapidly cool the melt in order to ensure a desired fine-grained structure of the layer material and to avoid separations and liquations during the solidification, dependent on the alloy. Since fluctuations concerning the treatment temperature have a disadvantageous effect on the bonding between the metal carrier and the layer material, it is necessary to ensure a thermal compensation after the heating of the metal carrier, which in the case of suitable forward feed speeds leads to a high overall length of the units used for the production of such stratified composite materials, which then require the supply of long strips as metal carriers. Moreover, a complex cooling of the metal carrier is necessary after the casting of the melt of the layer material on the side of the metal carrier which is averted from the layer material in order to achieve a solidification of the melt starting out from the metal carrier and progressing to the outside.

In order to shorten the overall length of conventional systems for producing stratified composite materials as are used in sliding bearings for example and consist of a strip-like steel carrier and a layer material on the basis of copper, it is already known (GB 2 383 051 A) to scatter the layer material onto the steel carrier in the form of a sintering powder and to melt the same with the help of laser beams in a locally limited longitudinal region under simultaneous heating of a surface layer of the steel carrier to the treatment temperature before the locally limited melting region of the layer material is cooled from the opposite side of the steel carrier. This known production method however requires the application of expensive sintering powders and complex laser devices.

SUMMARY OF THE INVENTION

It is an object of the invention to provide a method for producing a stratified composite material of the kind mentioned above so that strip-like metal carriers of shorter length can be joined advantageously with a metallic layer material into a stratified composite material.

This object is achieved with a method for producing a stratified composite material comprised of a strip-shaped metal carrier and a layer material, which comprises the steps of heating the strip-shaped metal carrier continuously with a temperature profile whose temperature decreases from a maximum temperature in the region of a surface of the carrier to a temperature of a core layer of the carrier, which maximum temperature is below a treatment temperature required for bonding the layer material to the carrier, subsequently casting an overheated melt of the layer material progressively onto the surface of the carrier as the carrier is moved in a forward feed direction whereby the overheated melt heats the surface layer to the required treatment temperature, and cooling the layer material melt below the melting temperature by the metal carrier onto which the melt has been cast.

The preconditions for a short overall length for producing a stratified composite material of the kind mentioned above and thus for the use of shorter metal carriers are created by the heating of the metal carrier continuously in the forward feed direction with a temperature drop from a surface layer to a core layer, because a temperature compensation with the metal carrier is to be avoided. Since the highest temperature in a layer close to the surface of the metal carrier prior to the casting of the melt of the layer material lies below the treatment temperature required for the bonding and the thermal quantity required for the heating of the surface layer to the treatment temperature is transmitted from the overhead melt onto the metal carrier, the temperature gradient between the layer close to the surface and the core layer is increased in the metal carrier with the effect that the solidification of the melt is initiated advantageously starting from the surface of the metal carrier, so that a solidification is obtained progressing from the inside to the outside, leading to a fine-crystalline structure of the layer material, especially in the case of a suitable cooling of the metal carrier on the side averted from the melt.

Due to the heating of the layer close to the surface by the cast overheated melt, the temperature drop from the surface layer to the core layer of the metal carrier can be comparatively small prior to the casting of the melt because the temperature gradient relevant for initiating the solidification of the melt is increased with the subsequent heating of the surface layer to the treatment temperature. In most cases it is therefore sufficient when the metal carrier is heated to a temperature profile with a temperature drop of a least 5° K/mm.

Since in the case of a inductive heating of a metallic material the penetration depth of the electromagnetic alternating field depends primarily on the frequency, and the temperature profile achievable with such an inductive heating depends on the penetration depth of the alternating field, it is recommended to heat the strip-like metal carrier in an inductive way in order to ensure an advantageous temperature profile in the metal carrier with the necessary precision directly before the casting of the melt.

BRIEF DESCRIPTION OF THE DRAWINGS

The method in accordance with the invention is explained below in detail by reference to the enclosed drawings, wherein.

DESCRIPTION OF THE PREFERRED EMBODIMENT

Figure 1:
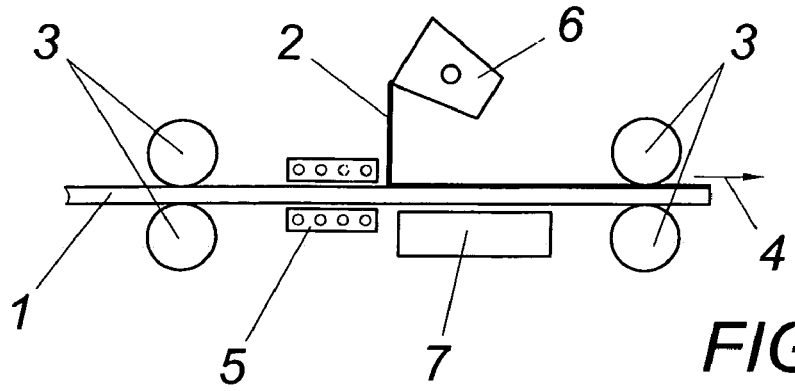
FIG. 1 shows an apparatus for producing a stratified composite material according to the method in accordance with the invention in a schematic longitudinal view.

According to FIG. 1, in which the usual pre-treatments of a metal carrier 1 for casting the melt 2 of a layer material and the usual after-treatments of the stratified composite material are omitted, the strip-like metal carrier 1 (a steel strip of limited length for example) is conveyed with the help of drive rollers 3 in the forward feed direction 4 through a device 5 for inductive heating in order to enable the casting of the melt 2 of the layer material (e.g. a bronze alloy used as a material for a sliding bearing) directly after the heating device 5. For this purpose, a casting device 6 in the form of a casting container receiving the melt is arranged adjacent to the heating device. The strip-like metal carrier 1 can have longitudinal edges which are bent up in the conventional manner so that the melt cannot flow off laterally from the metal carrier. A cooling device 7 is provided on the opposite bottom side of the metal carrier 1 for cooling the melt cast onto the metal carrier 1.

Figure 2:
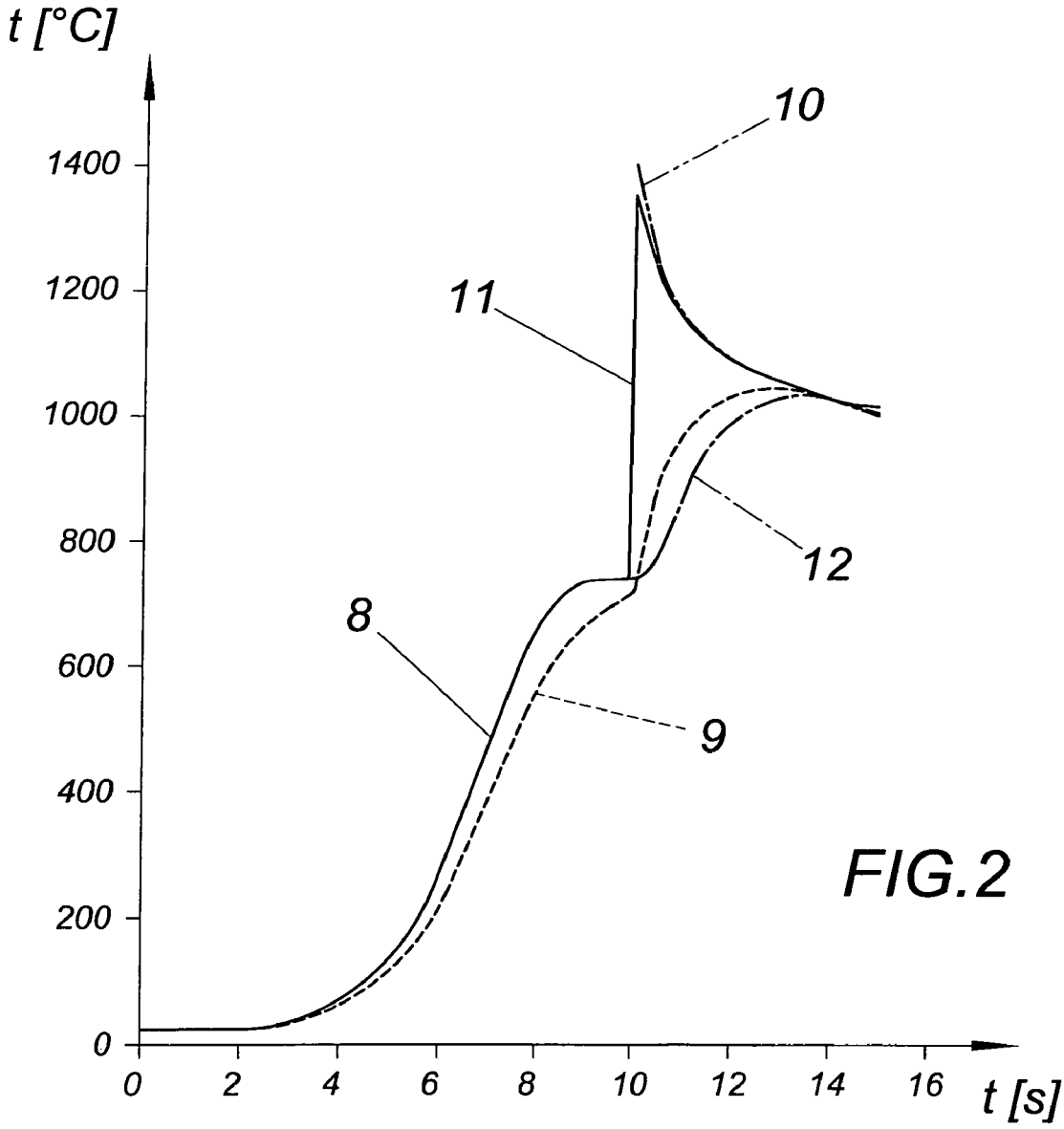
FIG. 2 shows the temperature profile over time of a steel metal carrier during the inductive heating and after the casting of an overheated melt of a copper-based layer of material.

The strip-like metal carrier 1 is heated by the inductive heating device 5 in the manner shown in FIG. 2. The frequency of the induced electromagnetic field and the heating output are adjusted to each other in such a way the Curie temperature is reached after approximately six seconds in the region of the lower and upper surface layer of the steel metal carrier 1, as is shown by the curve section 8 for the upper and lower surface layers of the metal carrier. The core layer of the metal carrier 1 is heated with a time delay according to curve 9, so that temperature drop occurs between a highest temperature in the region of the surface layers on the opposite sides of the metal carrier 1 and the core temperature. The upper surface layer of the metal carrier 1 is rapidly heated to a surface temperature close to the casting temperature of the melt 2 with the casting of the melt 2, which is overheated to approximately 1400° C. This is indicated by temperature curve 10. As a result of this heating, the temperature of the core layer is increased by thermal conductivity and, to a lesser extent, also the temperature of the lower surface layer of the metal strip 1. This is indicated by the progress over time of the temperature curve 9 for the core layer and the curve section 12 for the lower of the two surface layers of the metal carrier 1. At the same time, the melt 2 is cooled by heat absorption together with the upper of the two opposite surface layers, as is shown by the descending branch of the curve section 11 for the upper surface layer of the metal carrier 1 and the temperature curve 10 on the outer surface of the melt 2. As a result of the thus obtained temperature profile over the thickness of the stratified composite material, a considerable temperature drop is obtained from the outer surface of the stratified composite material to the lower surface layer of the metal carrier 1, with the effect that the solidification of the melt 2 starts advantageously from the metal strip 1 and progresses from the inside to the outside through the layer thickness. This produces advantageous preconditions for a fine-crystalline structure of the layer material, especially when the cooling is supported by a cooling apparatus 7 at the lower side of the metal carrier 1.

The invention claimed is:

1. A method for producing a stratified composite material comprised of a strip-shaped metal carrier and a layer material, which comprises the steps of (a) heating the strip-shaped metal carrier continuously with a temperature profile whose temperature decreases from a maximum temperature in the region of a surface of the carrier to a temperature of a core layer of the carrier, which maximum temperature is below a treatment temperature required for bonding the layer material to the carrier, (b) subsequently casting an overheated melt of the layer material progressively onto the surface of the carrier as the carrier is moved in a forward feed direction whereby the overheated melt heats the surface layer to the required treatment temperature, and (c) cooling the layer material melt below the melting temperature by the metal carrier onto which the melt has been cast.

2. The method of claim 1, wherein the temperature profile has a drop of at least 5° K/mm from the surface to the core layer.

3. The method of claim 1, wherein the strip-like metal carrier is heated inductively with the temperature profile.

* * * * *